US009891582B2

(12) United States Patent
Yoshikawa et al.

(10) Patent No.: US 9,891,582 B2
(45) Date of Patent: Feb. 13, 2018

(54) PROCESS UNIT AND IMAGE FORMING APPARATUS PROVIDED WITH THE SAME

(71) Applicant: Sharp Kabushiki Kaisha, Osaka (JP)

(72) Inventors: Yoshihiro Yoshikawa, Osaka (JP); Yuhsuke Yoshimoto, Osaka (JP); Takeshi Nishiyama, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 15/262,659

(22) Filed: Sep. 12, 2016

(65) Prior Publication Data

US 2017/0090404 A1 Mar. 30, 2017

(30) Foreign Application Priority Data

Sep. 29, 2015 (JP) ..... 2015-191805

(51) Int. Cl.
*G03G 21/18* (2006.01)

(52) U.S. Cl.
CPC ..... *G03G 21/18* (2013.01); *G03G 21/181* (2013.01); *G03G 21/1814* (2013.01); *G03G 2215/0132* (2013.01)

(58) Field of Classification Search
CPC ..... G03G 21/181; G03G 21/1814; G03G 2221/1648; G03G 15/0898
See application file for complete search history.

(56) References Cited

U.S. PATENT DOCUMENTS 5,697,022 A * 12/1997 Matsuda ..... G03G 21/1832 399/102
6,137,970 A * 10/2000 Sasago ..... G03G 21/1832 399/106
6,356,723 B1 * 3/2002 Sato ..... G03G 15/0817 399/103
6,505,020 B1 * 1/2003 Higeta ..... G03G 21/181 399/103
7,177,565 B1 * 2/2007 Miller ..... G03G 15/0817 399/103
2006/0083540 A1 * 4/2006 Kadowaki ..... G03G 21/105 399/102
2008/0310884 A1 * 12/2008 Matsumoto ..... G03G 15/0874 399/262
2017/0108824 A1 * 4/2017 Kawakami ..... G03G 21/1814

FOREIGN PATENT DOCUMENTS

JP 01245278 A * 9/1989 ..... G03G 21/1832
JP 10-104996 A 4/1998
JP 2004157465 A * 6/2004 ..... G03G 21/181
JP 2014224996 A * 12/2014 ..... G03G 15/0898

* cited by examiner

*Primary Examiner* — Sevan A Aydin
(74) *Attorney, Agent, or Firm* — Renner, Otto, Boisselle & Sklar, LLP

(57) ABSTRACT

A process unit includes a photoreceptor drum, a frame and seal members. The photoreceptor drum has drum flanges protruded outwardly from both end surfaces of a substrate. The frame supports the photoreceptor drum rotatably. The seal members are provided between both end surfaces of the photoreceptor drum and the frame, and support the drum flanges. Each of the seal members includes an elastic member and a hard member. The elastic member and the hard member are adhered and laminated with each other in an axial direction of the photoreceptor drum. Furthermore, the hard member is arranged so as to be brought into contact with the photoreceptor drum.

6 Claims, 9 Drawing Sheets

FIG. 4 (A) FRONT SIDE
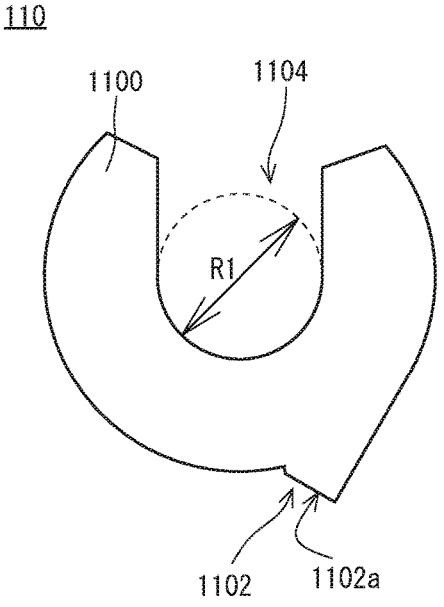
FIG. 4 (B) RIGHT SIDE
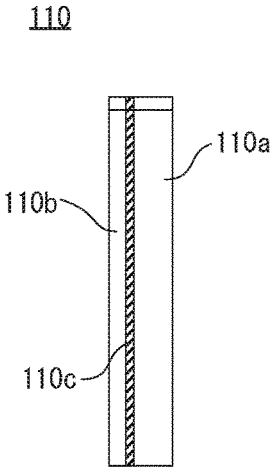
FIG. 4 (C) LEFT SIDE
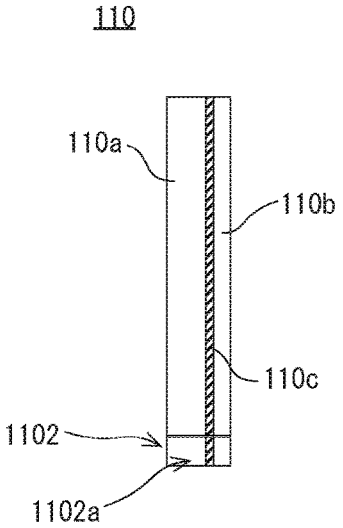

FIG. 6 (A) FRONT SIDE
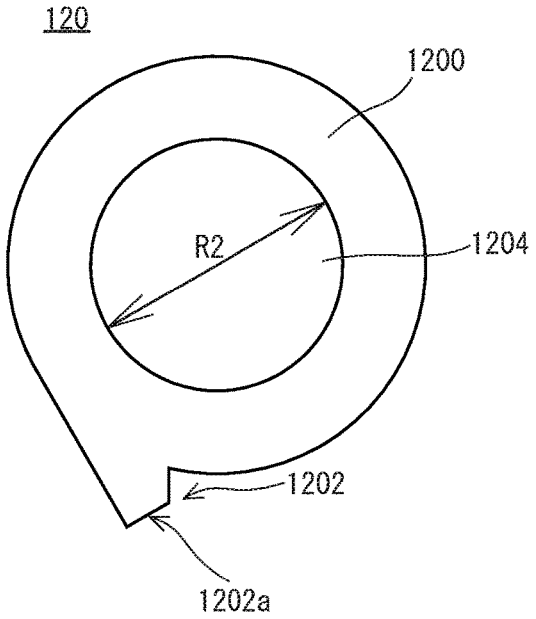
FIG. 6 (B) RIGHT SIDE
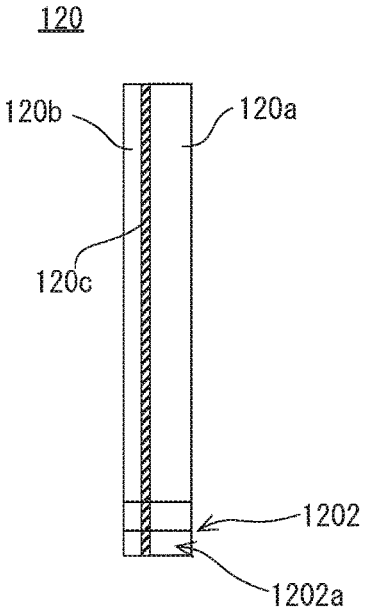
FIG. 6 (C) LEFT SIDE
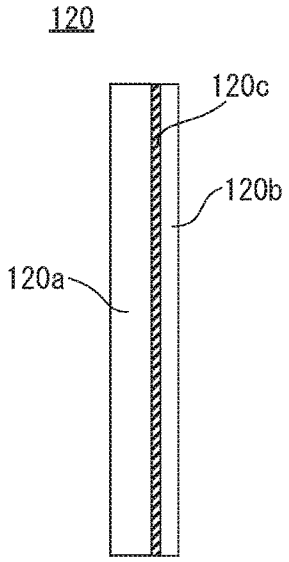

FIG. 9(A) RIGHT SIDE OF FIRST SEAL MEMBER
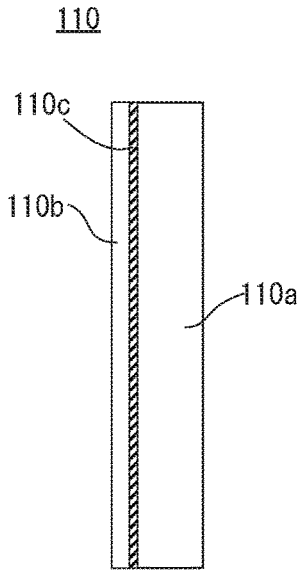
FIG. 9(B) RIGHT SIDE OF SECOND SEAL MEMBER
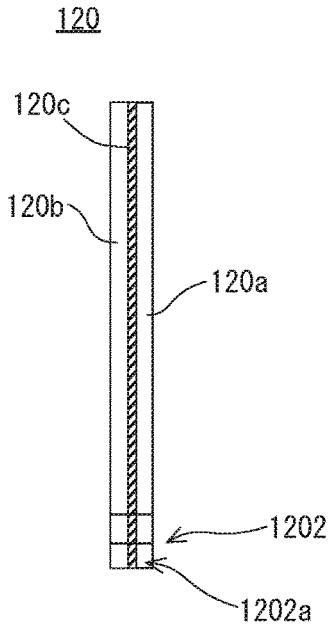

PROCESS UNIT AND IMAGE FORMING APPARATUS PROVIDED WITH THE SAME

CROSS REFERENCE OF RELATED APPLICATION

The disclosure of Japanese patent application No. 2015-191805 filed on Sep. 29, 2015 is incorporated by reference.

BACKGROUND OF THE INVENTION

Field of the Invention

The present invention relates to a process unit and an image forming apparatus provided with the same, and more specifically, a process unit and an image forming apparatus provided with the same, comprising at least an electrostatic latent image bearing member.

Description of the Related Art

An example of a related art is disclosed in Japanese patent application laying-open No. H10-104996 [G03G 21/00] laid-open on Apr. 24, 1998 (Literature 1). An image forming apparatus disclosed in this literature 1 comprises a process cartridge that a photoreceptor drum is supported by a cleaning frame in a manner that both ends of a penetration shaft inserted into an inside of the photoreceptor drum are supported by the cleaning frame.

In the image forming apparatus disclosed in the literature 1, when assembling the process cartridge, the photoreceptor drum is temporarily placed on the cleaning frame, and the penetration shaft is inserted into the photoreceptor drum being temporarily placed. The photoreceptor drum is positioned by inserting the penetration shaft, and pivotally supported by the cleaning frame. Therefore, it is necessary to provide a mechanism for temporarily placing (holding) the photoreceptor drum so as not to be brought into contact with surrounding components prior to inserting the penetration shaft.

Furthermore, in the image forming apparatus disclosed in the literature 1, since there are gaps between the both end surfaces of the photoreceptor drum in the axial direction and the cleaning frame, if the photoreceptor drum is rotated at a high speed, a toner is sucked through these gaps. Therefore, it is desirable to provide seal member so as to fill-up the gaps, for example.

However, it is necessary to ensure a space where it is provided with a mechanism for holding an electrostatic latent image bearing member such as a photoreceptor drum prior to insertion of the penetration shaft and spaces for providing the seal members, and therefore, the process cartridge becomes large.

SUMMARY OF THE INVENTION

The present invention is made in view of the above, and it is an object of the present invention to provide a process unit and an image forming apparatus provided with the same, capable of holding an electrostatic latent image bearing member and preventing a toner from being sucked, without increasing a size of apparatus.

A first invention is a process unit, comprising an electrostatic latent image bearing member, a frame and seal members. The electrostatic latent image bearing member is a photoreceptor drum, for example, and has flanges protruded from both end surfaces of a substrate that is formed in a cylinder shape. The frame supports the electrostatic latent image bearing member rotatably. The seal members are provided between both end surfaces of the electrostatic latent image bearing member and the frame, and hold the electrostatic latent image bearing member concerned by supporting the flange. Furthermore, each of the seal members is formed by laminating a hard member that is brought into contact with the electrostatic latent image bearing member and an elastic member that is brought into contact with the frame. As the hard member of the seal member, it is possible to use resin material such as polyethylene terephthalate (PET), polyethylene, polypropylene, polystyrene, polyurethane and polycarbonate, for example. Furthermore, as the elastic member of the seal member, it is possible to use a moltopren, rubber, etc., for example.

According to the first invention, since the flanges of the electrostatic latent image bearing member are supported by the seal members each comprising the hard member, it is possible to hold the electrostatic latent image bearing member prior to inserting the penetration shaft. That is, even if no mechanism for holding the electrostatic latent image bearing member is provided on the frame, it is possible to hold the electrostatic latent image bearing member at a correct position prior to positioning thereof. Furthermore, according to the first invention, since the seal members are provided between the both end surfaces of the electrostatic latent image bearing member and the frame, gaps between the both end surfaces of the electrostatic latent image bearing member and the frame can be closed and thus it is possible to prevent suction of a toner at the time of rotation of the electrostatic latent image bearing member. Furthermore, according to the first invention, since the hard member of the seal member is provided at a side of the electrostatic latent image bearing member, it is possible to improve wear resistance of the seal member at the time of rotation of the electrostatic latent image bearing member.

A second invention is the process unit according to the first invention, wherein one of the seal members provided between one of the both end surfaces of the electrostatic latent image bearing member and the frame is formed in a U-letter shape, and the other of the seal members provided between the other of the both end surfaces of the electrostatic latent image bearing member and the frame is formed in an annular shape.

According to the second invention, since the one of the seal members is formed in a U-letter shape that opens upward, one of the flanges of the electrostatic latent image bearing member can be inserted from an opened portion in attaching the electrostatic latent image bearing member to the frame, and accordingly, an attaching work of the electrostatic latent image bearing member is easy.

A third invention is the process unit according to the first invention, wherein each of the seal members is formed in an annular shape.

According to the third invention, since each of the seal members is formed in an annular shape, the gaps between the both end surfaces of the electrostatic latent image bearing member and the frame are made narrower, and accordingly, it is possible to improve a capability to prevent the suction of the toner at the time of rotation of the electrostatic latent image bearing member.

A fourth invention is the process unit according to the first invention, wherein a thickness of the elastic member of one of the seal members is made larger than a thickness of the elastic member of the other of the seal members.

According to the fourth invention, when attaching the electrostatic latent image bearing member to the frame, one of the both end surfaces of the electrostatic latant image bearing member is pressed against the one of the seal members having a large thickness of the elastic member, whereby the one of the seal members can be compressed in a laminating direction. It is possible to make the other of the seal members hold the other of the both end surfaces of the electrostatic latent image bearing member in this state. Therefore, an attaching work of the electrostatic latent image bearing member is easy.

A fifth invention is the process unit according to the first invention, wherein each of the seal members has a projection portion that is protruded outwardly, and each of the frames has an inclined surface that is brought into contact with a tip surface of the projection portion.

According to the fifth invention, since a direction and a position of the seal member are settled when the projection portion of the seal member and the inclined surface of the frame are brought into contact with each other, an attaching work of the seal member is easy.

A sixth invention is an image forming apparatus that comprises the process unit of the first invention.

According to the sixth invention, the same advantage can be expected, and it is possible to hold the electrostatic latent image bearing member prior to positioning thereof, and prevent suction of the toner at the time of rotation of the electrostatic latent image bearing member.

The above mentioned objects and other objects, features, aspects and advantages of the present invention will become more apparent from the following detailed description of the present invention when taken in conjunction with the accompanying drawings.

BRIEF DESCRIPTION OF THE DRAWINGS

FIG. 4(A) is a front view of appearance structure of a first seal member, FIG. 4(B) is a right side view of the appearance structure of the first seal member, and FIG. 4(C) is a left side view of the appearance structure of the first seal member.

FIG. 6(A) is a front view of appearance structure of a second seal member, FIG. 6(B) is a right side view of the appearance structure of the second seal member, and FIG. 6(C) is a left side view of the appearance structure of the second seal member.

FIG. 9(A) is a right side view showing a first seal member according to a third embodiment, and FIG. 9(B) is a right side view showing a second seal member of the third embodiment.

DETAILED DESCRIPTION OF NON-LIMITING EXAMPLE EMBODIMENTS

First Embodiment

Figure 1:
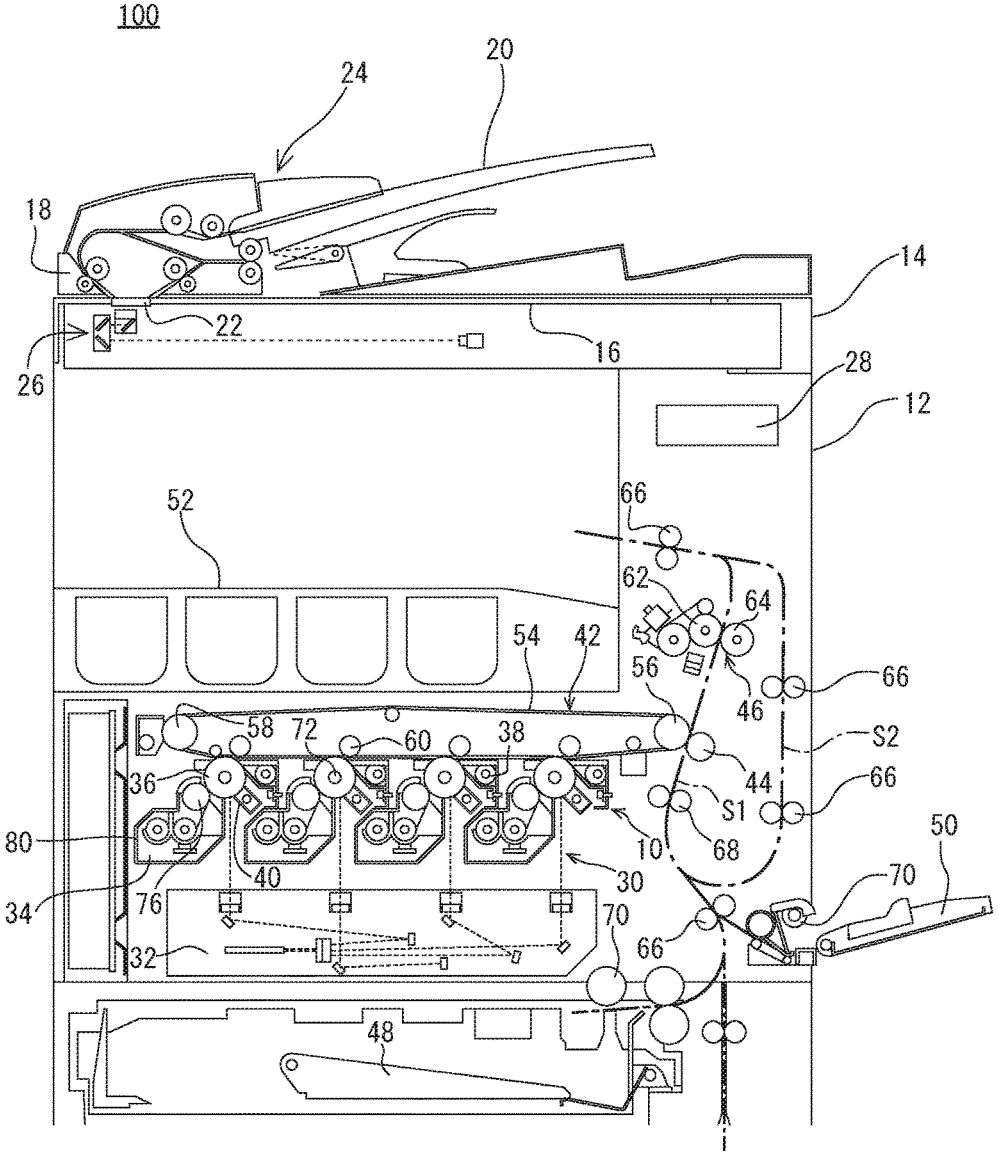
FIG. 1 is a schematic sectional view showing internal structure of an image forming apparatus that comprises a process unit according to a first embodiment of the present invention.

FIG. 1 is a schematic sectional view showing internal structure of a multifunction peripheral 100 that comprises a process unit 10 according to the first embodiment of the present invention.

With reference to FIG. 1, the process unit 10 according to the first embodiment of the present invention is a unit that a photoreceptor drum 36, a cleaner unit 38, a charger 40, etc. are unitized with using a frame 74, and provided attachably or detachably to or from an image forming apparatus such as a copying machine, a facsimile, a printer, a multifunction peripheral compounding these, etc. This first embodiment shows an example that the process unit 10 is applied to the multifunction peripheral (MFP) 100 having a copying function, a printer function, a scanner function, a facsimile function, etc.

First, structure of the multifunction peripheral 100 will be schematically described. As shown in FIG. 1, the multifunction peripheral 100 includes an MFP main body 12 and an image reading apparatus 14 that is arranged above thereof.

The image reading apparatus 14 comprises an original platen 16 that is formed of transparent material. A platen cover 18 is attached above the original platen 16 via a hinge etc. to be opened and closed freely. This platen cover 18 is provided with an ADF (Automatic Document Feeder) 24 that automatically feeds an original that is put on an original tray 20 one by one to an image reading position 22. Furthermore, an operating portion that receives an input operation by a user is provided on a front side of the original platen 16.

Furthermore, the image reading apparatus 14 is incorporated with an image scanner 26 that comprises a light source, a plurality of mirrors, a focusing lens, a line sensor, etc. The image scanner 26 exposes a surface of an original by the light source, and leads a reflected light that is reflected from the surface of the original to the focusing lens by the plurality of mirrors. Then, the reflected light is focused onto photoreceptor elements of the line sensor by the focusing lens. The line sensor detects brightness and chromaticity of the reflected light that is focused onto the photoreceptor elements, and produces image data based on an image of the original surface. As the line sensor, a CCD (Charge Coupled Device), a CIS (Contact Image Sensor), etc. may be used.

The MFP main body 12 is incorporated with a control portion 28 and an image forming portion 30, etc. The control portion 28 comprises a CPU, memories, etc., and transmits control signals to respective components or portions of the multifunction peripheral 100 according to the input operation to the operating portion such as a touch panel or the like so as to make the multifunction peripheral 100 perform various kinds of operations or actions.

The image forming portion 30 comprises an exposure unit 32, a developing unit 34, a photoreceptor drum 36, a cleaner unit 38, a charger 40, an intermediate transfer belt unit 42, a transfer roller (secondary transfer roller) 44, a fixing unit 46, etc., and forms an image on a paper that is fed from a paper feeding cassette 48 or a manual paper feeding tray 50, and discharges a paper having been formed with the image onto a paper discharge tray 52. As image data for forming an image on a paper, image data read by the image scanner 26, image data transmitted from an external computer, etc. can be utilized.

In addition, image data treated in the multifunction peripheral 100 corresponds to a color image of four (4) colors of black (BK), cyan (C), magenta (M) and yellow (Y). Therefore, the developing unit 34, the photoreceptor drum 36, the cleaner unit 38 and the charger 40 are respectively provided by four (4) so that four (4) kinds of latent images corresponding to respective colors can be formed, and four (4) image stations are constituted by these components. Furthermore, the photoreceptor drum 36, the cleaner unit 38 and the charger 40 are unitized (built into cartridge), and these components constitute the process unit 10. That is, four (4) process units 10 each comprising the photoreceptor drum 36, the cleaner unit 38, the charger 40, etc. are provided in the image forming portion 30.

The photoreceptor drum 36 is an image bearing member that a photosensitive layer is formed on a surface of a cylindrical substrate 360 (see FIG. 3) having conductivity, and made rotatable about an axis line by a driving portion (not shown). The charger 40 is a member for charging a surface of the photoreceptor drum 36 at a predetermined electric potential. In this embodiment, as the charger 40, a corona discharger is used, but a brush type charger, a roller type charger, an ion generator, etc. can be used. Furthermore, the exposure unit 32 is constructed as a laser scanning unit (LSU) that comprises a laser emitting portion and reflecting mirrors, etc., and exposes the surface of the photoreceptor drum 36 being charged, thereby forming an electrostatic latent image according to image data on the surface of the photoreceptor drum 36. The cleaner unit 38 removes and collects the toner that remains on the surface of the photoreceptor drum 36 after transfer of a toner image onto the intermediate transfer belt 54.

The developing unit 34 visualizes (forms a toner image) the electrostatic latent image that is formed on the surface of the photoreceptor drum 36 with toners of four (4) colors (YMCK), and comprises a developing roller 76 etc. that supplies a toner to the photoreceptor drum 36. The developing roller 76 is arranged in a position close to a horizontal direction with respect to the photoreceptor drum 36, and is made rotatable by a driving portion (not shown) about an axis line. Furthermore, a developer (two-component developer) that includes a toner and a carrier is stored in a development tank 80 of the developing unit 34, and the toner included in this developer is supplied to the photoreceptor drum 36 via the developing roller 76.

The intermediate transfer belt unit 42 comprises an intermediate transfer belt 54, a driving roller 56, a driven roller 58, four (4) intermediate transfer rollers 60, etc., and is arranged above the photoreceptor drum 36. The intermediate transfer belt 54 is provided so as to be brought into contact with each photoreceptor drums 36, and a multicolor toner image is formed on the intermediate transfer belt 54 by sequentially transferring each color toner image that is formed on each photoreceptor drum 36 onto the intermediate transfer belt 54 in an overlapped manner. Furthermore, the transfer roller 44 is arranged near the driving roller 56, and when a paper passes through a nip region between the intermediate transfer belt 54 and the transfer roller 44, the toner image that is formed on the intermediate transfer belt 54 is transferred onto the paper.

The fixing unit 46 comprises a heat roller 62 and a pressure roller 64, and is arranged above the transfer roller 44. The heat roller 62 is controlled to be rendered at a predetermined fixing temperature, and when a paper passes a nip region between the heat roller 62 and the pressure roller 64, the toner image that is transferred onto the paper is melted, mixed and pressured, whereby the toner image can be heat-fixed on the paper.

Furthermore, in such the MFP main body 12, there is formed with a first paper path S1 for feeding a paper put on a paper feed cassette 48 or a manual paper feed cassette 50 to a paper discharge tray 52 via a resist roller 68, the transfer roller 44 and the fixing unit 46. Furthermore, there is formed with a second paper feeding path S2 for returning a paper after passing the fixing unit 46 while having completed simplex printing to the first paper path S1 in an upstream side of a paper feeding direction by the transfer roller 44 when performing duplex printing onto the paper. A plurality of feeding rollers 66 for auxiliary applying a propulsive force to a paper are suitably provided in these first paper feeding path S1 and second feeding paper path S2.

When performing simplex printing in the MFP main body 12, a paper put on the paper feeding cassette 48 or a manual paper feeding cassette 50 is led one by one to the first paper path S1 by a pickup roller 70, and fed by the feeding rollers 66 to the resist roller 68. Then, the paper is fed at a timing that a tip end of the paper and a tip end of the toner image on the intermediate transfer belt 54 are consistent with each other by the resist roller 68, whereby the toner image can be transferred onto the paper. Thereafter, an unfixed toner on a paper is melted and fixed when the paper passes through the fixing unit 46, and the paper is discharged on the paper discharge tray 52 via the paper feeding rollers (paper discharge rollers) 66.

On the other hand, if performing duplex printing, the paper is fed backward to be led to the second paper feeding path S2 by reversely rotating the paper discharge rollers 66 when a tail end of the paper while having completed simplex printing passing through the fixing unit 46 reaches the paper discharge rollers 66 near the paper discharge tray 52. The paper led to the second paper path S2 is fed in the second paper feeding path S2 by the paper feeding rollers 66, and is further led to the first paper path S1 in an upstream side of a paper feeding direction than the resist roller 68. Since the back and front of the paper is reversed at this time, when the paper passes the secondary transfer roller 44 and the fixing unit 46 after that, printing is performed on the back of the paper.

Figure 2:
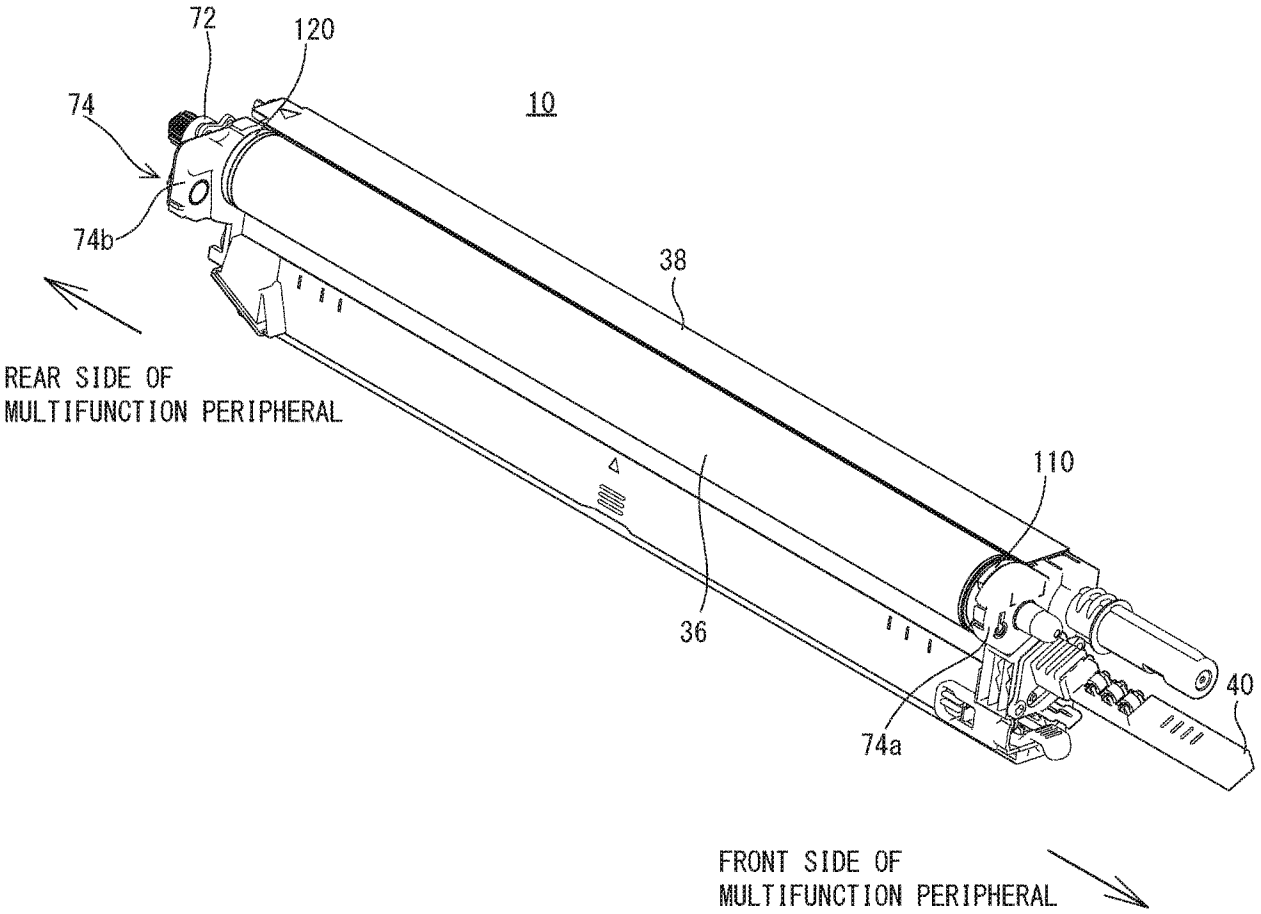
FIG. 2 is a perspective view showing appearance structure of the process unit of FIG. 1.
Figure 3:
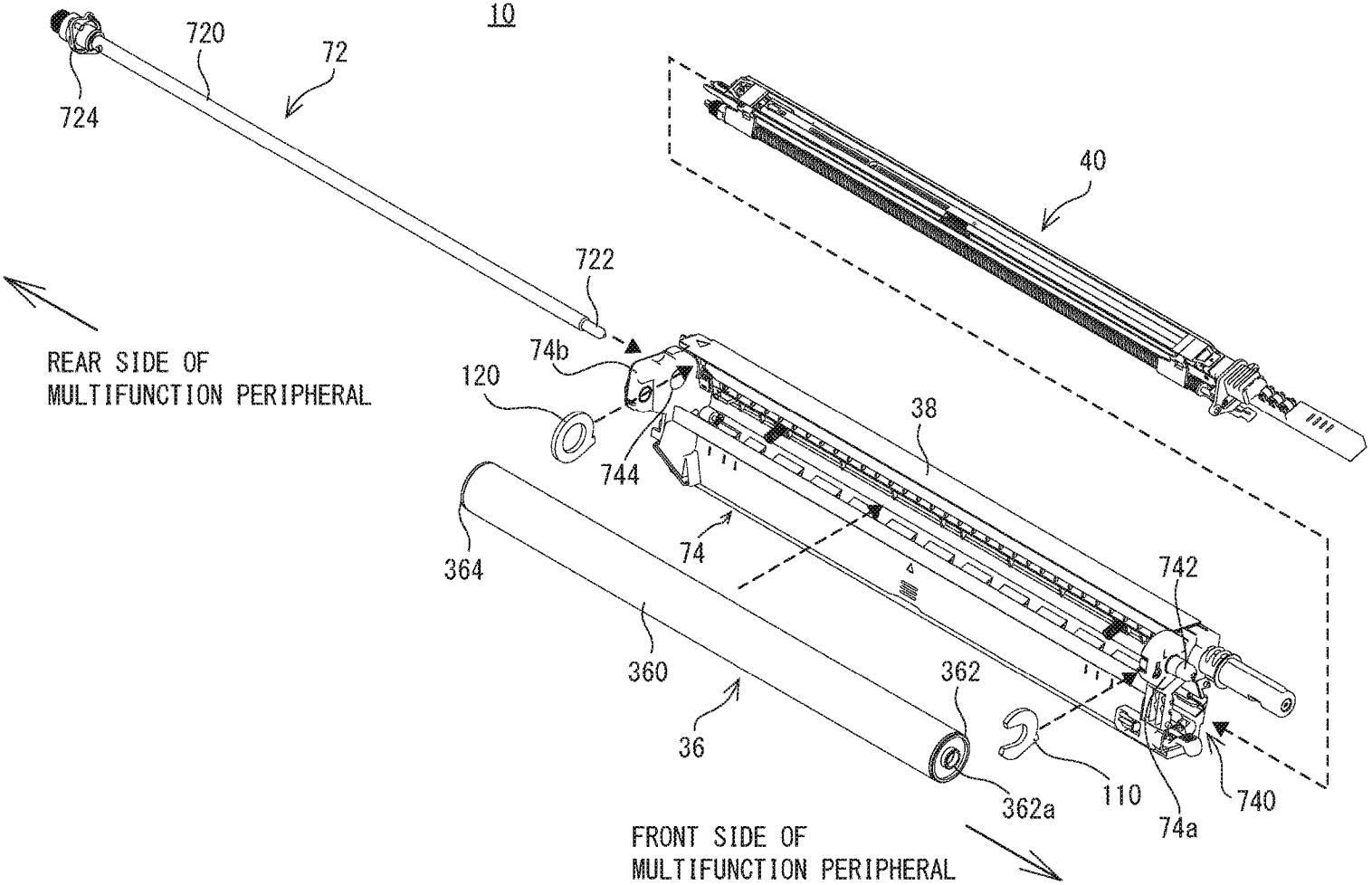
FIG. 3 is a perspective view showing structure of the process unit in a disassembled state.

Subsequently, with reference to FIG. 2 and FIG. 3, structure of the process unit 10 will be described specifically. FIG. 2 is a perspective view showing an example of appearance structure of the process unit 10 of FIG. 1. FIG. 3 is a perspective view showing an example of the appearance structure of the process unit 10 in a disassembled state.

In addition, in FIG. 2 and FIG. 3, a right side of the process unit 10 when viewing a longitudinal direction of the process unit 10 from a side of the photoreceptor drum 36 is corresponding to a front side of the multifunction peripheral 100, and a left side of the process unit 10 when viewing the longitudinal direction of the process unit 10 from the side of the photoreceptor drum 36 is corresponding to a rear side of the multifunction peripheral 100. Furthermore, FIG. 3 shows a state where the cleaner unit 38 is attached to a frame 74.

As shown in FIG. 2 and FIG. 3, the process unit 10 comprises the photoreceptor drum 36, the cleaner unit 38 and the charger 40, and these components are integrally held in a predetermined arrangement manner by the frame 74. Furthermore, as described later in detail, seal members (110, 120) are provided between the frame 74 and both end surfaces of the photoreceptor drum 36. The process unit 10 can be attached to or detached from the MFP main body 12 at the front side thereof, and is attached to or detached from the MFP main body 12 by sliding it in a depth direction (a front and rear direction).

As shown in FIG. 3, the photoreceptor drum 36 includes a substrate 360, a first flange member 362 and a second flange member 364. The substrate 360 is, as described above, formed in a cylindrical shape, and the first flange member 362 and the second flange member 364 are provided at two (2) opening portions of the cylindrical shape. For example, the first flange member 362 is provided at the opening portion in a right side of the substrate 360, and the second flange member 364 is provided at the opening portion in a left side of the substrate 360.

In addition, although the first flange member 362 and the second flange member 364 are distinguished from each other for convenience of explanation, these may be the same members.

The first flange member 362 has a first drum flange 362*a* that is outwardly protruded in an axis direction of the substrate 360. Furthermore, although illustration is omitted, like the first flange member 362, the second flange member 364 has a second drum flange 364*a* that is outwardly protruded in the axis direction of the substrate 360. Each of the first drum flange 362*a* and the second drum flange 364*a* is coaxial with the substrate 36, and formed in a cylindrical shape having a diameter smaller than that of the substrate 360.

The charger 40 includes an electric discharging wire that is arranged in a manner that a longitudinal direction thereof corresponds to the axial line direction of the photoreceptor drum 36. Furthermore, as shown in FIG. 3, the charger 40 is attached or detached through a hole 740 that is formed in a right side member 74*a* of the frame 74.

A drum shaft 72 is inserted into the photoreceptor drum 36 so as to function as an axis member. The drum shaft 72 includes a shaft main body 720, a tip portion 722 and a fixing portion 724. The shaft main body 720 is a metal shaft that is a solid cylindrical shape (shape of round bar), and penetrates an inside of the substrate 360, the first drum flange 362*a* and the second drum flange 364*a*. An outer diameter of this shaft main body 720 is set up slightly smaller than an inner diameter of each of the first drum flange 362*a* and the second drum flange 364*a* to the extent no backlash occurs.

The tip portion 722 is formed in a solid cylindrical shape in one end portion of the shaft main body 720, and an outer diameter of the tip portion 722 is set up smaller than an outer diameter of the shaft main body 720. This tip portion 722 is a portion to be inserted, when attaching the drum shaft 72 to the frame 74, into a bearing portion 742 that is formed in the right side member 74*a* of the frame 74. By inserting the tip portion 722 into the bearing portion 742, a right end portion of the drum shaft 72 is supported. However, the drum shaft 72 is inserted from a hole 744 that is formed in the left side member 74*b* of the frame 74.

The fixing portion 724 is a member that is provided in another end portion of the shaft main body 720, and fixes the drum shaft 72 to the frame 74. In addition, structure of the fixing portion 724 and a method of fixing the drum shaft 72 to the frame 74 are not essential for the present invention and already well-known, and therefore, a description thereof is omitted in this specification.

By the drum shaft 72 having such the structure, the photoreceptor drum 36 is rotatably supported on the frame 74. In this instance, the photoreceptor drum 36 is arranged by the drum shaft 72 in a predetermined position of the frame 74. Therefore, the drum shaft 72 functions also as a positioning member of the photoreceptor drum 36.

Thus, since the photoreceptor drum 36 is supported on the frame 74 with using the drum shaft 72 in the process unit 10 of this first embodiment, it is a common technique or method that the photoreceptor drum 36 is temporarily placed (held) in a state where a surface of the substrate 360 is made not to be brought into contact with other components, and then, the drum shaft 72 is attached in a state of holding the photoreceptor drum 36. Accordingly, it is thinkable to provide a mechanism for holding the photoreceptor drum 36 on the frame 74.

Furthermore, if the process unit 10 is attached to the multifunction peripheral 100 and the photoreceptor drum 36 is rotated when operating the multifunction peripheral 100, the toner is sucked, by a wind pressure due to its rotation, into gaps between left and right end surfaces of the substrate 360 (surfaces of the first flange member 362 and the second flange member 364) and the frame 74, there is adversely affect such sucked toner adheres to the intermediate transfer belt 54. Accordingly, it is thinkable that the gaps are filled up with seal members.

However, when such seal members are provided while providing the above-described mechanism for holding photoreceptor drum 36, the process unit 10 will become large. Accordingly, the multifunction peripheral 100 will also be enlarged.

Therefore, in the first embodiment, the photoreceptor drum 36 can be held by the drum shaft 72 before it becomes to be supported by the frame 74, and also, suction of the toner at the time of rotation of the photoreceptor drum 36 can be prevented, without enlarging the apparatus.

As shown in FIG. 3, in this first embodiment, a first seal member 110 and a second seal member 120 are provided between the photoreceptor drum 36 and the frame 74. More specifically, the first seal member 110 is provided between a right end surface of the photoreceptor drum 36 (surface of the first flange member 362) and an inner side surface of a right side member 74*a* of the frame 74. The second seal member 120 is provided between a left end surface of the photoreceptor drum 36 (surface of the second flange member 364) and an inner side surface of a left side member 74*b* of the frame 74.

Figure 7A:
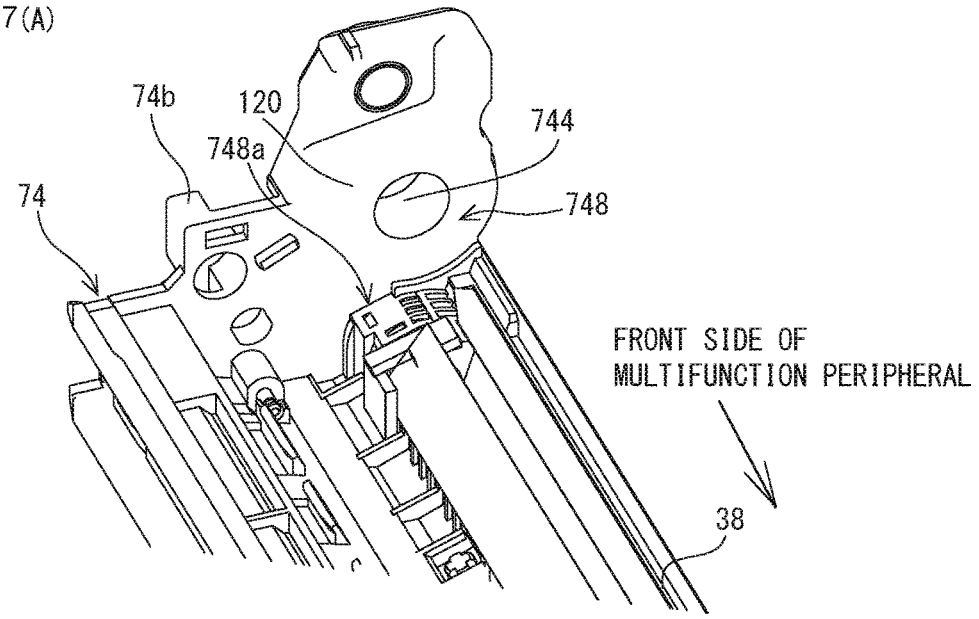
FIG. 7(A) is an enlarged perspective view showing a left end portion of the frame of the process unit.
Figure 7B:
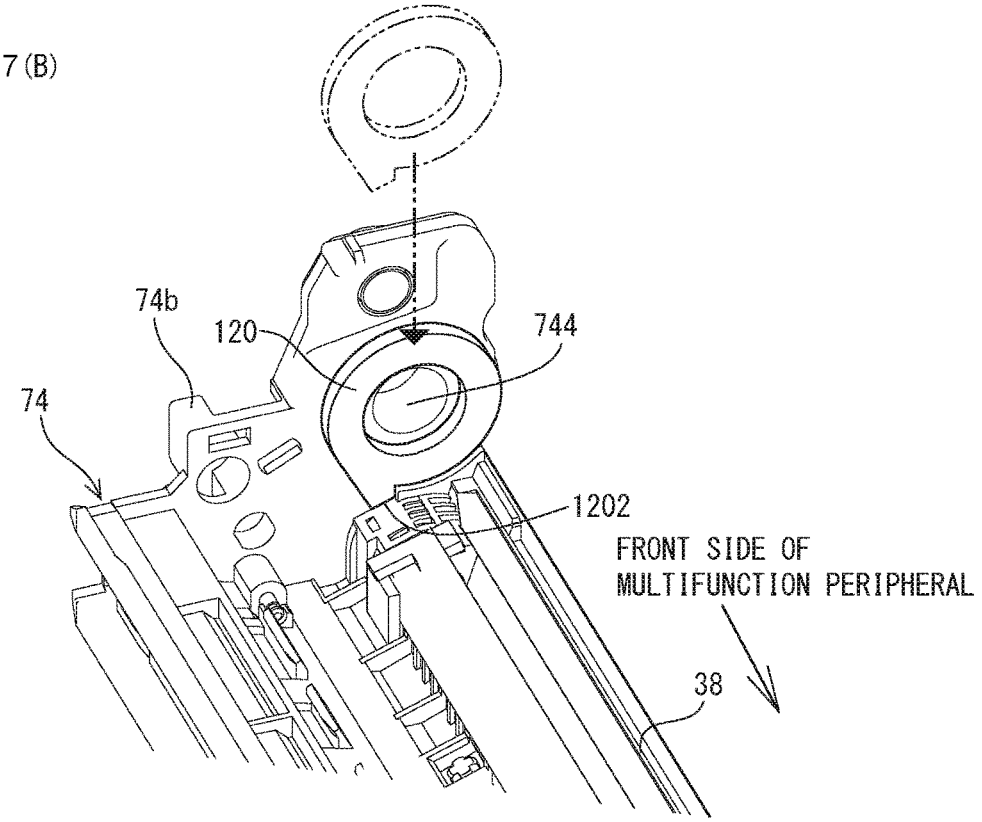
FIG. 7(B) is an enlarged perspective view showing the left end portion of the frame when attaching the second seal member to the frame.

FIG. 4(A) is a front view of appearance structure of the first seal member 110, FIG. 4(B) is a right side view of the appearance structure of the first seal member 110, and FIG. 4(C) is a left side view of the appearance structure of the first seal member 110. FIG. 5(A) is an enlarged perspective view showing a right end portion of the frame 74 of the process unit 10, and FIG. 5(B) is an illustration view showing a state where the first seal member 110 is attached to the frame 74. FIG. 6(A) is a front view of appearance structure of the second seal member 120, FIG. 6(B) is a right side view of the appearance structure of the second seal member 120, and FIG. 6(C) is a left side view of the appearance structure of the second seal member 120. FIG. 7(A) is an enlarged perspective view showing a left end portion of the frame 74 of the process unit 10, and FIG. 7(B) is an illustration view showing a state where the second seal member 120 is attached to the frame 74.

As shown in FIG. 4(A), the first seal member 110 includes a main body 1100 of a U-letter shape that a part of a ring is opened, and a projection portion 1102 that is provided to be continued from the main body 1100 and protruded outwardly. A diameter R1 of a notch portion 1104 that is an opened portion of the U-letter shape of the main body 1100 is set up approximately the same as an outer diameter of the first drum flange 362*a*. The projection portion 1102 is protruded toward a direction (downward in FIG. 4(A)) opposite to a direction that the U-letter shape is opened, and has a tip surface 1102*a* facing a left oblique downward direction in FIG. 4(A).

Furthermore, as shown in FIG. 4(B) and FIG. 4(C), the first seal member 110 is formed by stacking an elastic member 110*a* and a hard member 110*b* that are adhered to each other by an adhesive agent 110*c*. As shown in FIG. 4(A)-FIG. 4(C), the elastic member 110*a* and the hard member 110*b* are the same or almost the same in a shape or form when viewing from the front. The elastic member 110*a* is an elastic body such as a moltopren, soft rubber, etc., for example, and has a predetermined thickness. The predetermined thickness is set up slightly larger than a gap between the photoreceptor drum 36 and the right side member 74*a*. Therefore, if putting on the photoreceptor drum 36, the first seal member 110 becomes a state where it is compressed in a thickness direction (the direction of the axis line of the photoreceptor drum 36). The hard member 110*b* is a resin sheet having flexibility, such as polyethylene terephthalate (PET), polyethylene, polypropylene, polystyrene, polyurethane, polycarbonate, etc., for example.

In addition, although the elastic member 110*a* and the hard member 110*b* are adhered to each other with using the adhesive agent 110*c*, these may be stuck to each other with using a double-sided tape. The same is true for the second seal member 120 described later.

A reason why the first seal member 110 is thus constituted by adhering the elastic member 110*a* and the hard material 110*b* with the adhesive agent 110*c* is that in order to have a strength necessary for holding the photoreceptor drum 36 and prevent a running torque from becoming excessive. The same is true for the second seal member 120 described later.

In addition, if forming the first seal member 110 only by a soft elastic member, for example, when putting on the photoreceptor drum 36, the first seal member 110 is deformed by its weight, it is impossible to hold the photoreceptor drum 36 in a correct position. Furthermore, if forming the first seal member 110 only by a hard elastic member, for example, although the photoreceptor drum 36 can be held in a correct position, since a repulsion force becomes larger than a necessary strength, that is, a frictional force between the elastic member and the photoreceptor drum 36 becomes excessive, a running torque becomes excessive.

Figure 5:
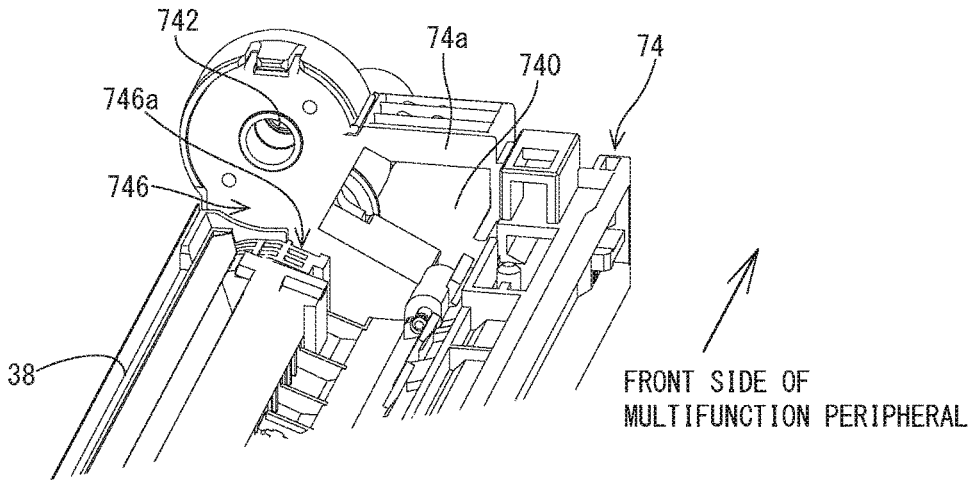
FIG. 5(A) is an enlarged perspective view showing a right end portion of a frame of the process unit.
FIG. 5(B) is an enlarged perspective view showing the right end portion of the frame when attaching the first seal member to the frame.
Figure 5:
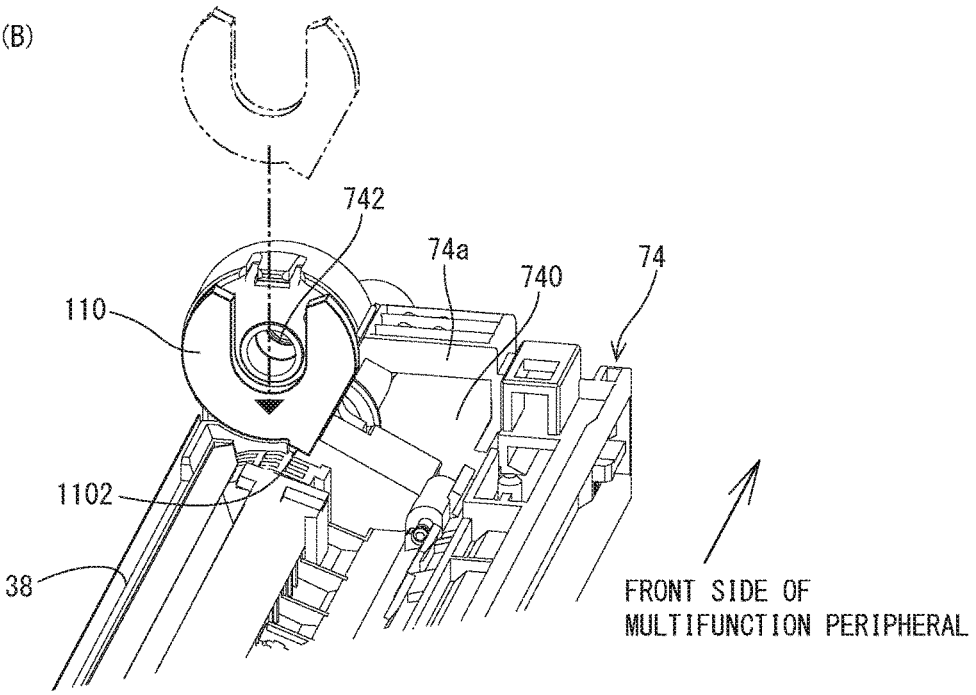

As shown in FIG. 5 (A), a portion (attaching portion) 746 for attaching (sticking) the first seal member 110 to the inner side surface of the right side member 74*a* is formed on the frame 74. The attaching portion 746 is brought into contact with a part of first seal member 110 comprising the projection portion 1102, and has an inclined surface 746*a* that is abutted with the tip surface 1102*a* of the projection portion 1102.

As shown in FIG. 5 (B), the first seal member 110 is attached to an inner side of the right side member 74*a* of the frame 74. Specifically, the elastic member 110*a* of the first seal members 110 is adhered (stuck) to the frame 74. In such a case, the first seal member 110 is arranged so that the tip surface 1102*a* of the projection portion 1102 is brought into contact with the inclined surface 746*a*. Therefore, a direction and a position of the first seal member 110 are determined by the projection portion 1102 and the attaching portion 746. Furthermore, if sticking the first seal member 110 onto the frame 74, the hard member 110*b* is arranged at a side contacting (abutting) with the side surface (the first flange member 362) of the photoreceptor drum 36. This is for holding the photoreceptor drum 36, as described later. The same is true for the second seal member 120 described later.

Furthermore, as shown in FIG. 6(A), the second seal member 120 includes a Main body 1200 of an annular shape (shape of ring) and a projection portion 1202 that is provided to be continued from the Main body 1200 and protruded outwardly. A diameter R2 of a circle (hole) 1204 of a hollow main body 1200 is set up larger than an outer diameter of the second drum flange 364*a* and smaller than an outer diameter of the second flange member 364. The projection portion 1202 has a tip surface 1202*a* that is protruded downward and goes to a right oblique direction in FIG. 6 (A).

Furthermore, as shown in FIG. 6(B) and FIG. 6(C), the second seal member 120 is, like the first seal member 110, formed by stacking an elastic member 120*a* and a hard member 120*b* that are adhered to each other by an adhesive agent 120*c*. As shown in FIG. 6(A)-FIG. 6(C), the elastic member 120*a* and the hard member 120*b* are the same or almost the same in a shape or form when viewing from the front. As the elastic member 120*a* and the hard member 120*b*, it is possible to use an elastic body and a resin sheet explained about the first seal member 110. However, the elastic member 120*a* has a predetermined thickness. The predetermined thickness is set up slightly larger than a gap between the photoreceptor drum 36 and the left side member 74*b*. Therefore, if putting on the photoreceptor drum 36, the second seal member 120 becomes to a state where it is compressed in a thickness direction (the direction of the axis line of the photoreceptor drum 36).

As shown in FIG. 7(A), a portion (attaching portion) 748 for attaching (sticking) the second seal member 120 to the inner side surface of the left side member 74*b* is formed in the frame 74. The attaching portion 748 has an inclined surface 748*a* that is brought into contact with a part of second seal member 120 comprising the projection portion 1202, and the inclined surface 748*a* is farther brought into contact with the tip surface 1102*a* of the projection portion 1102.

As shown in FIG. 7(B), the second seal member 120 is attached to an inner side of the left side member 74*b* of the frame 74. Specifically, the elastic member 120*a* of the second seal member 120 is adhered (stuck) to the frame 74. In such a case, the second seal member 120 is arranged so that the tip surface 1202*a* of the projection portion 1202 is brought into contact to the inclined surface 748*a*. Therefore, a direction and a position of the second seal member 120 are determined by the projection portion 1202 and the attaching portion 748. Furthermore, if sticking the second seal member 120 onto the frame 74, the hard member 120*b* is arranged at a side contacting (abutting) with the side surface (the second flange member 364) of the photoreceptor drum 36.

Since such the first seal member 110 and the second seal member 120 are provided, when assembling the process unit 10, the second drum flange 364*a* of the photoreceptor drum 36 is inserted into the hole 1204 of the second seal member 120 that is stuck onto the frame 74 in a state where the photoreceptor drum 36 is made oblique to the longitudinal direction of the frame 74. Subsequently, the first drum flange 362*a* is inserted into the notch portion 1104 from the opened portion of the main body 1100 so that the first drum flange 362*a* of the photoreceptor drum 36 can be supported in the notch portion 1104 of the first seal member 110 that is stuck onto the frame 74. Therefore, the photoreceptor drum 36 is held by the first seal member 110 and the second seal member 120. The drum shaft 72 is attached in a state where the photoreceptor drum 36 is thus held, whereby the photoreceptor drum 36 can be rotatably supported by the frame 74 as shown in FIG. 2.

According to this first embodiment, since the first drum flange 362*a* and the second drum flange 364*a* of the photoreceptor drum 36 are supported by the first seal member 110 and the second seal member 120 comprising the hard members 110*b* and 120*b*, it is possible to hold the photoreceptor drum 36 before it becomes to be pivotally supported by the drum shaft 72. That is, even if the frame 74 is not provided with a mechanism for holding the photoreceptor drum 36, the photoreceptor drum 36 can be held in a correct position before positioning thereof.

Furthermore, according to the first embodiment, since the first seal member 110 and the second seal member 120 are provided between the both end surfaces of the photoreceptor drum 36 and the frame 74, the gaps between the both end surfaces of the photoreceptor drum 36 and the frame 74 are filled up, and therefore, it is possible to prevent suction of the toner at the time of rotation of the photoreceptor drum 36.

Furthermore, according to the first embodiment, since the hard members 110*b* and 120*b* are provided at a side of the photoreceptor drum 36, it is possible to improve wear resistance of the first seal member 110 and the second seal member 120 at the time of rotation of the photoreceptor drum 36.

Furthermore, according to the first embodiment, the first seal member 110 is formed in a U-letter shape by opening a part of the main body 1100, and when attaching the photoreceptor drum 36, the first drum flange 362*a* can be inserted form the opened portion, and accordingly, an attaching work of the photoreceptor drum 36 is easy.

In addition, in the first embodiment, although the Main body 1200 of the second seal member 120 is formed in a ring shape, it does not need to be limited to this. For example, like the first seal member 110, the second seal member 120 may be formed in a shape that a part of the main bodies 1200 is opened, and the second drum flange 364*a* may be inserted into the hole 1204 (in this case, notch portion) from the opened portion.

Furthermore, in the first embodiment, although the elastic member 110*a* and the hard member 110*b* are the same or almost the same in a shape or form when viewing from the front, and the elastic member 120*a* and the hard member 120*b* are the same or almost the same in a shape or form when viewing from the front, it does not need to be limited to this. It is only necessary to hold in a predetermined position before pivotally supporting the photoreceptor drum 36 with the drum shaft 72, for example, about each of the hard members 110*b* and 120*b*, a portion where no load of the photoreceptor drum 36 is applied may be omitted.

Second Embodiment

Since a multifunction peripheral 100 according to the second embodiment is the same or similar to the multifunction peripheral 100 according to the first embodiment except that the main body 1100 of the first seal member 110 is formed in a shape of ring, portions different from those of the first embodiment will be described, and a duplicate description will be omitted.

FIG. 8(A) is a front view showing appearance structure of a first seal member 110 of the second embodiment, and FIG. 8(B) is a perspective view showing a part of the process unit 10 viewed from an oblique direction in a state where the first seal member 110 of the second embodiment is stuck to the frame 74.

Figure 8:
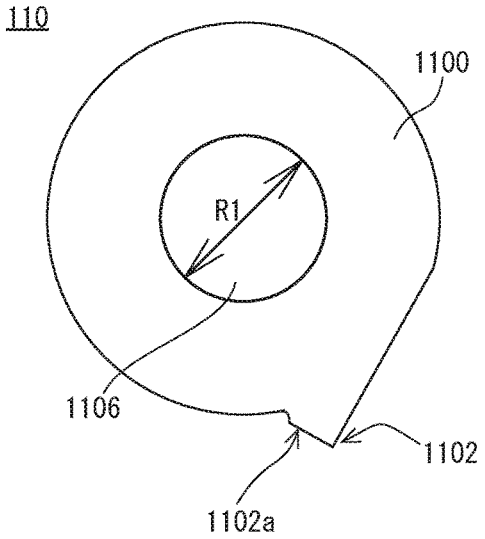
FIG. 8(A) is a front view showing appearance structure of a first seal member according to a second embodiment.
FIG. 8(B) is a perspective view showing a part of the process unit viewed from an oblique direction in a state where the first seal member of the second embodiment is stuck to the frame.
Figure 8:
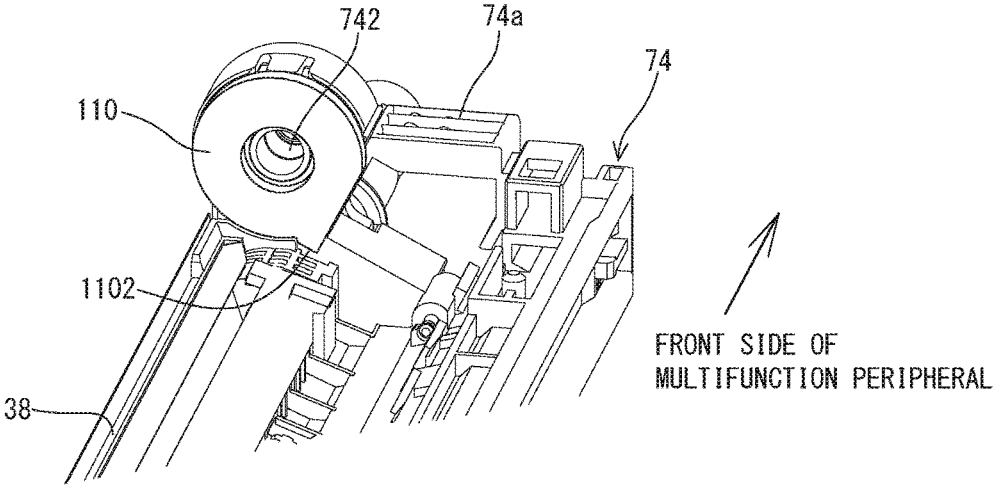

As shown in FIG. 8 (A), in the second embodiment, a main body 1100 of the first seal member 110 is formed in a shape of ring. Therefore, a hole 1106 is formed in the main body 1100 instead of the notch portion 1104. A diameter R1 of this hole 1106 is set up approximately the same as an outer diameter of the first drum flange 362*a*.

In this case, when assembling the process unit 10, for example, the second drum flange 364*a* of the photoreceptor drum 36 is inserted into the hole 1204 of the second seal member 120 that is stuck to the frame 74 in a state where the photoreceptor drum 36 is made oblique to the longitudinal direction of the frame 74. Subsequently, the first drum flange 362*a* of the photoreceptor drum 36 is inserted into the hole 1106 of the first seal member 110 that is stuck to the frame 74. In this case, when inserting the first drum flange 362*a* into the hole 1106 of the first seal member 110, the elastic member 120*a* is compressed in a thickness direction by slightly pushing the photoreceptor drum 36 toward a side of the second seal member 120.

However, the second drum flange 364*a* may be inserted into the hole 1204 of the second seal member 120 after inserting the first drum flange 362*a* into the hole 1106 of the first seal member 110. In such a case, when inserting the second drum flange 364*a* into the hole 1204 of the second seal member 120, the elastic member 110*a* is compressed in the thickness direction by slightly pushing the photoreceptor drum 36 toward a side of the first seal member 110.

According to this second embodiment, since each of the first seal member 110 and the second seal member 120 is formed in a shape of ring, there is no gap between the both end surfaces of the photoreceptor drum 36 and the frame 74, it is possible to improve a capability to prevent suction of the toner at the time of rotation of the photoreceptor drum 36.

Third Embodiment

Since a multifunction peripheral 100 according to the third embodiment is the same or similar to the multifunction peripheral 100 according to the second embodiment except that a thickness of a first seal member 110 is made larger than the thickness of the second seal member 120, portions different from those of the second embodiment will be described, and a duplicate description will be omitted.

FIG. 9(A) is a right side view showing a first seal member 100 of the third embodiment, and FIG. 9(B) is a right side view showing a second seal member 120 of the third embodiment.

As shown in FIG. 9(A) and FIG. 9(B), in the third embodiment, the thickness of the elastic member 110*a* of the first seal member 110 is set up larger than the thickness of the elastic member 120*a* of the second seal member 120. The thickness of the elastic member 110*a* of the first seal member 110 is set up 1.5 to 2 times the thickness of the elastic member 120*a* of the second seal member 120, for example.

In this case, when assembling the process unit 10, for example, the first drum flange 362*a* of the photoreceptor drum 36 is inserted into the hole 1106 of the first seal member 110 that is stuck to the frame 74 in a state where the photoreceptor drum 36 is made oblique to the longitudinal direction of the frame 74. Subsequently, the second drum flange 364*a* of the photoreceptor drum 36 is inserted into the hole 1204 of the second seal member 120 that is stuck to the frame 74. At this time, the elastic member 110*a* is compressed in a thickness direction by pushing the photoreceptor drum 36 toward a side of the first seal member 110. Since the thickness of the elastic member 110*a* is made larger than the thickness of the elastic member 120*a* as described above, the elastic member 110*a* can be compressed easily. Accordingly, an attaching work of the photoreceptor drum 36 is easy.

Although the thickness of the elastic member 110*a* is made larger than the thickness of the elastic member 120*a* in this third embodiment, the thickness of the elastic member 120*a* may be made larger than the thickness of the elastic member 110*a*.

In such a case, the first drum flange 362*a* may be inserted into the hole 1106 of the first seal member 110 after inserting the second drum flange 364*a* into the hole 1204 of the second seal member 120. In this case, when inserting the first drum flange 362*a* into the hole 1204 of the first seal member 120, the elastic member 120*a* is compressed in the thickness direction by pushing the photoreceptor drum 36 toward a side of the second seal member 120.

According to this third embodiment, even if forming each of the first seal member 110 and the second seal member 120 in a ring shape, an attaching work of the photoreceptor drum 36 is easy.

In addition, a modification shown in the third embodiment is applicable also to the process unit 10 of the first embodiment.

It should be noted that the specific numerical values, etc. described in the above-described embodiments are only examples, and to be set or changed appropriately in accordance with the actual products.

Although the present invention has been mentioned and illustrated in detail, it is clearly understood that the same is by way of illustration and example only and is not to be taken by way of limitation, the spirit and scope of the present invention being limited only by the terms of the appended claims.

What is claimed is:

1. A process unit, comprising an electrostatic latent image bearing member having flanges protruded from both end surfaces of a substrate that is formed in a cylinder shape;

a frame that supports the electrostatic latent image bearing member rotatably; and seal members provided between both end surfaces of the electrostatic latent image bearing member and the frame, the seal members holding the electrostatic latent image bearing member concerned by supporting the flange, each of the seal members being formed by laminating a hard member that is brought into contact with the electrostatic latent image bearing member and an elastic member that is brought into contact with the frame.

2. The process unit according to claim 1, wherein one of the seal members provided between one of the both end surfaces of the electrostatic latent image bearing member and the frame is formed in a U-letter shape, and the other of the seal members provided between the other of the both end surface of the electrostatic latent image bearing member and the frame is formed in an annular shape.

3. The process unit according to claim 1, wherein each of the seal members is formed in an annular shape.

4. The process unit according to claim 1, wherein a thickness of the elastic member of one of the seal members is made larger than a thickness of the elastic member of the other of the seal members.

5. The process unit according to claim 1, wherein each of the seal members has a projection portion that is protruded outwardly, and each of the frames has an inclined surface that is brought into contact with a tip surface of the projection portion.

6. An image forming apparatus, comprising: the process unit according to claim 1.

* * * * *